United States Patent [19]

Krebs

[11] 4,033,321

[45] July 5, 1977

[54] WINDOWED OVEN DOORS

[75] Inventor: Jacob Krebs, St. Clair Shores, Mich.

[73] Assignee: Shatterproof Glass Corporation, Detroit, Mich.

[22] Filed: Jan. 14, 1976

[21] Appl. No.: 649,053

[52] U.S. Cl. ..... 126/198; 126/200

[51] Int. Cl.[2] ..... F23M 7/04; F24C 15/04

[58] Field of Search ..... 126/198, 200; 52/616, 52/304

[56] References Cited

UNITED STATES PATENTS

| | | | |
|---|---|---|---|
| 1,360,393 | 11/1920 | Glendy et al. | 126/200 |
| 1,417,976 | 5/1922 | Curry et al. | 126/200 |
| 2,152,865 | 4/1939 | Bowers | 126/200 |
| 3,362,396 | 1/1968 | Hurkd | 126/200 |
| 3,863,619 | 2/1975 | Wolf | 126/198 X |
| 3,893,442 | 7/1975 | Nuss | 126/198 |

*Primary Examiner*—Irwin C. Cohen
*Attorney, Agent, or Firm*—William E. Nobbe

[57] ABSTRACT

An oven door for cooking ranges of the type provided with a double-glazed window comprised of at least two spaced parallel glass panels, including an outer panel and an inner panel. The door is provided with openings at the bottom and top thereof to permit the circulation of air upwardly through the space between the glass panels. The inner glass panel is preferably mounted in a fixed position in the door, while the outer glass panel is slidably mounted therein in a manner that it can be completely removed from the door through the opening at the top thereof by a simple upward sliding movement of said panel.

9 Claims, 7 Drawing Figures

WINDOWED OVEN DOORS

BACKGROUND OF THE INVENTION

The present invention relates to improvements in oven doors for domestic cooking ranges and more particularly to oven doors of the type provided with windows.

Oven doors of the above general character are commonly provided with double-glazed windows comprised of at least two spaced parallel glass panels, with an air space between them serving as an insulator to retard the escape of oven heat through the window. Ordinarily, the spaced glass panels are sealed around their peripheral edges to provide a dead air space therebetween.

Another type of double-glazed window is the so-called ventilated window in which the glass panels are mounted in spaced parallel relation in the door in such a manner that cooler air can pass upwardly through the space between the glass panels to displace the hotter air therein which emanates from the oven. This is commonly referred to as an "air wash".

A major objection to this type of window is that any dust, dirt or other foreign matter carried by the cooler air flowing into the space between the glass panels may be deposited on the inner surfaces of the panels, along with any gases which may leak from the oven into the space between the glass panels. These gases tend to condense on the inner surfaces of the panels, forming a thin film thereon. If these films, as well as any dust and dirt deposited on the inner surfaces of the glass panels, are not removed the panels may become clouded or discolored and visibility therethrough reduced, as well as detracting from their appearance.

In an endeavor to overcome this problem, it has been proposed to hinge or otherwise mount the outer glass panel of the window in a manner to permit access to the space between the panels. However, prior constructions have not proven entirely satisfactory in that, in some instances, the outer glass panel could only be removed by disassembling the door structure and, in others, by the removal of retaining means, such as screws. Other objections that have been raised to prior constructions include increased weight, number of parts and high cost. Proper cleaning of the glass panels is thus a difficult and time consuming task.

The present invention comprehends an improved double-glazed oven door of the ventilated type of simplified yet functional design in which the outer glass panel of the window can be easily and quickly removed from the door without disassembling or otherwise disturbing the door structure and without the use of any tools, thereby greatly facilitating the cleaning of the glass panels, as well as the replacement of the outer glass panel should it become broken.

Another object of the invention is to provide an oven door having a double-glazed window incorporated therein constructed in a novel manner such that the outer glass panel can be completely removed from the door structure for cleaning purposes or for replacement simply by sliding the said outer glass panel edgewise relative to the door proper.

Other objects and advantages of the invention will become apparent from the following detailed description of the preferred embodiments illustrated in the accompanying drawings.

DESCRIPTION OF THE PREFERRED EMBODIMENTS

Figure 1:
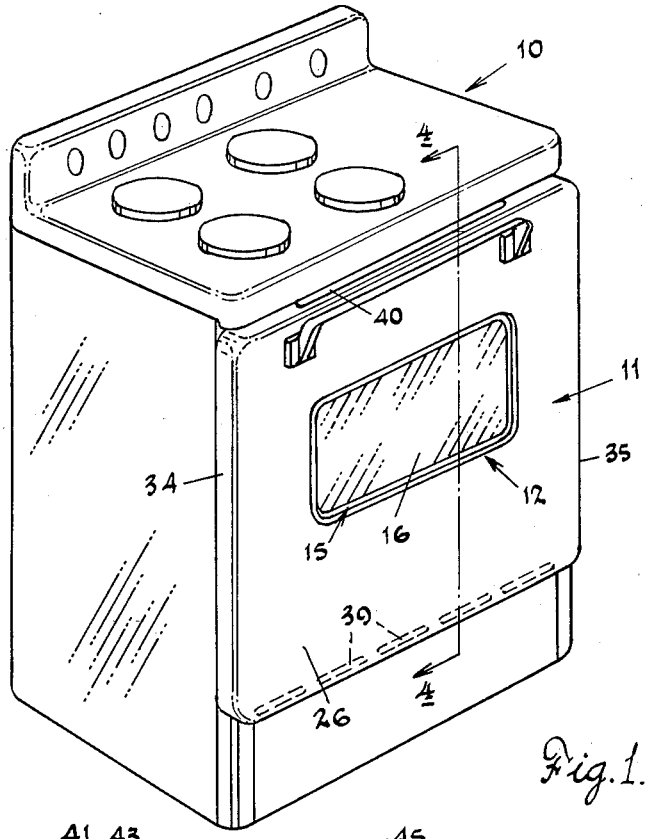
FIG. 1 is a perspective view of a domestic cooking range embodying a window unit for the oven door constructed in accordance with the present invention.
Figure 2:
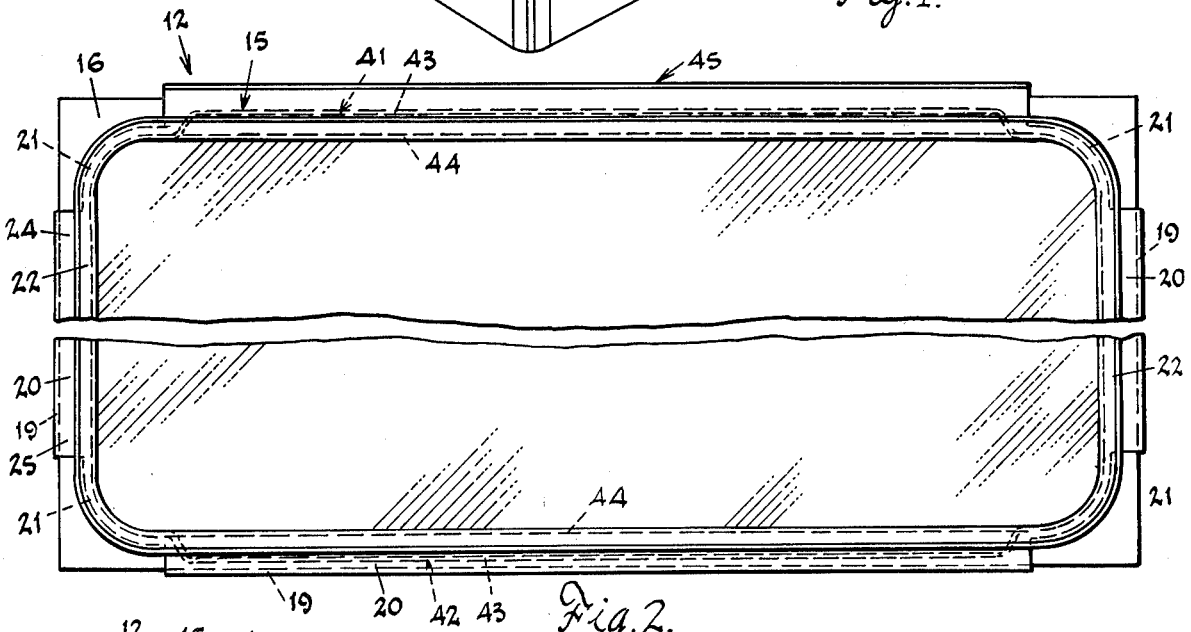
FIG. 2 is a front view of the window unit removed from the oven door.
Figure 3:
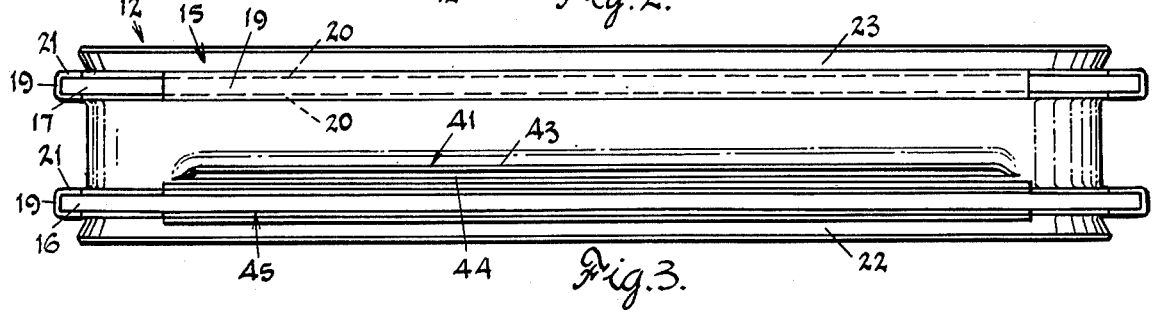
FIG. 3 is a top view of the window unit.

With reference to FIG. 1 of the drawings there is shown a floor standing domestic cooking range 10 provided with a door 11 for the oven compartment and in which is mounted a window unit 12 embodying the principles of the present invention.

Referring more particularly to the embodiment of the invention illustrated in FIGS. 2 to 5, the window unit 12 is comprised of spaced parallel outer and inner transparent glass panels 13 and 14 and a frame 15 preferably of a relatively light weight metal enclosing the peripheral edges of the glass panels to secure them in their spaced parallel relation.

The glass panels 13 and 14 shown in the drawings are generally rectangular and the frame 15 is designed to conform to the generally rectangular perimeter of the glass panels, said frame being provided with two parallel continuous glass receiving channels 16 and 17 which are separated by an integral spacer portion 18. At the corners of the window unit, the end walls 19 and portions of the side walls 20 of the glass receiving channels 16 and 17 are preferably cut out to form notched corner apertures 21 to permit bending of the frame without undesirable crimping and wrinkling at the corners as well as to permit the use of rectangular glass panels. Flanged rim portions 22 and 23 extend from the outer walls of the channel portions 16 and 17 respectively.

The metal frame 15 is preferably formed of two substantially U-shaped sections 24 and 25 which can be joined together at opposite sides of the frame in any suitable manner such as by the interlocking means disclosed in U.S. Pat. No. 3,418,779 dated Dec. 31, 1968.

The oven door 11 is generally of sheet metal construction and includes a front or outer door panel 26 and a rear or inner door panel 27, said panels being provided with aligned substantially rectangular openings defined by inwardly turned flanges 28 and 29 respectively which form a substantially centrally located window opening in which the window unit 12 is mounted. The door panels 26 and 27 are formed around their respective perimeters with inwardly directed overlapping flanges 30 and 31 which serves to locate them in predetermined relation and constitute a top wall 32, a bottom wall 33 and opposite side walls 34 and 35. The overlapping flanges 30 and 31 may be secured in assembled relation by spot welding or the like.

A vertical reinforcing or partition member 36, which may also be of sheet metal, is installed between the outer and inner door panels 26 and 27 to impart strength and rigidity to the door structure. The partition is preferably disposed substantially midway between the outer and inner door panels, with the space rearwardly of said partition being filled with an insulating material 37, such as fiber glass, to prevent excessive heating of the outer or fron door panel when the oven is in use, while the space 38 forwardly of partition 36 is an open space through which the cooler air is channeled to the window unit and the hotter air therefrom. The cooler air enters the space 38 through openings 39 in the bottom wall 33 of the door 11 and, after passing upwardly through the space between the glass panels, exits through an opening 40 in the top wall 32 of the door.

The window unit 12 is also provided with means for obtaining a more uniform flow of air upwardly through the space between the glass panels and across substantially the entire width of said panels in such a manner as to effect a more uniform cooling of the outer glass panel, as well as a more even distribution of heat in the oven itself. By uniformily cooling the outer glass panel across its entire width, the creation of excessive hot spots or areas in the panel will be eliminated.

This is accomplished by the provision of louvers 41 and 42 at the top and bottom respectively of the window unit 12 for directing the flow of ambient air upwardly into, through and out of the space between the glass panels. More particularly, each louver 41 and 42 consists of a relatively narrow elongated fin or vane 43 formed integral with the respective spacer portion 18 and disposed at an angle relative thereto. The vanes are struck from the spacer portions 18 resulting in correspondingly narrow elongated slots 44 defining passages for the circulation of air through the space between the glass panels, as indicated by the arrows in FIG. 4. The louvers extend substantially the entire width of the window to provide a uniform stream or blanket of air across the surface of the outer glass panel. The vane 43 of the louver 41 at the top of the window is angled forwardly and upwardly, while the vane of the louver 42 at the bottom thereof is angled forwardly and downwardly.

In order for an oven range to be acceptable for domestic use, it is required that the outer surface of the outer glass panel not exceed a specified maximum temperature when the oven is in use, the purpose being of course, to prevent persons, and especially children, from being burned should they accidently come in contact with the panel. The louvers 41 and 42 have proven to be highly effective in reducing the temperature of the outer glass panel to and maintaining it at an acceptable level.

The vanes 43 of the louvers 41 and 42 are usually disposed at an angle of about 45° relative to the spacer portions 18; however, they may be arranged at other angles as the particular oven construction and thermal requirements dictate. The angle of the vanes serves to determine the rate and/ or volume of air passing upwardly through the louvers into and through the window unit. It has been found that if the flow of cooler air into the bottom of the window is not properly regulated, the hot air therein will be forced upwardly into the space 38 above the window at such a rate that it will tend to back-up in the space 38 such as to cause overheating of the front metal door panel above the window. This is highly objectional since the outer door panel must also not exceed a permissible maximum surface temperature.

As brought out above, the present invention is particularly concerned with the provision of a windowed oven door of the above character in which the outer glass panel of the double-glazed window can be easily and quickly removed from the door for cleaning or for replacement without in any way disturbing the door structure and without the use of any tools.

To this end, the opening 40 in the top wall 32 of the door 11 is in the form of a relatively long narrow slot of a length slightly greater than the width of the outer glass panel 13. the end wall 19 at the top of the outer glass receiving channel 16 is also provided with a corresponding slot 45 which is in alignment with the slot 40 in the top of the door.

Figure 4:
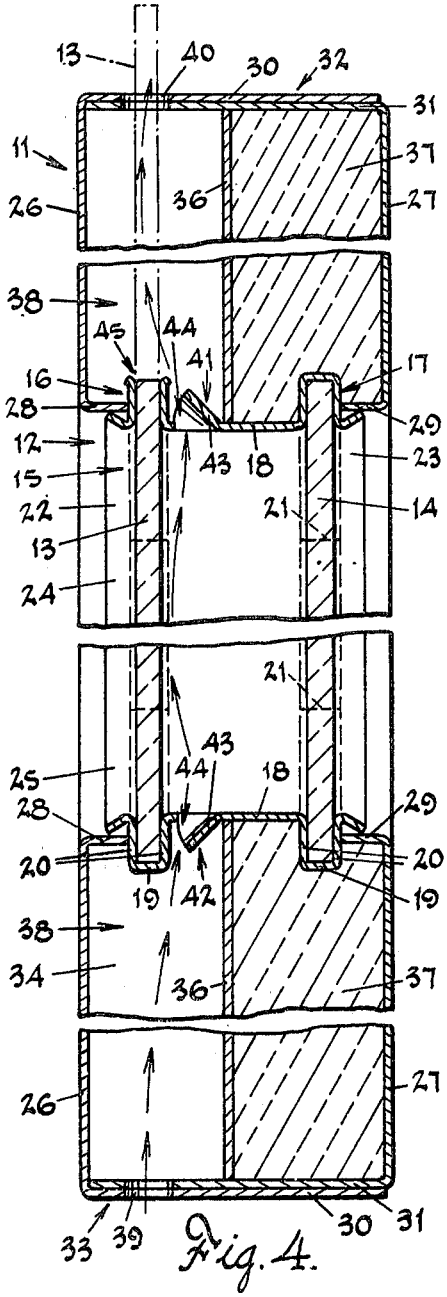
FIG. 4 is a vertical transverse sectional view taken substantially on line 4—4 of FIG. 1.
Figure 5:
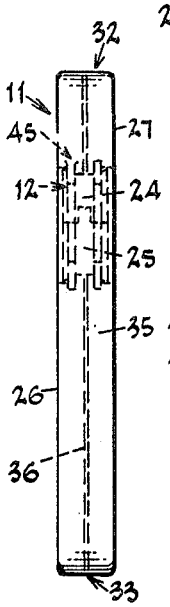
FIG. 5 is an end view of the window unit.

When it is desired to remove the outer glass panel 13, it is only necessary to apply an inward and upward hand pressure to the front surface of the outer glass panel and slide it upwardly in the channel 16 through the slot 45, and upon continued upward pressure through the slot 40 in the top wall of the door, as indicated in broken lines in FIG. 4. Thus the outer glass panel can be removed from the door by the simple application of hand pressure to the outer surface thereof. The inner surfaces of the two glass panels can then be readily cleaned and the outer panel replaced by inserting it downwardly through the aligned slots 40 and 45. If, for some reason it is desired to do so, the outer glass panel can be reversed when it is replaced in the door or a new panel inserted. The slot 40 in the top of the door serves the dual purpose of permitting escape of the hot air from the door to the ambient atmosphere and the removal and replacement of the outer glass panel.

Figure 6:
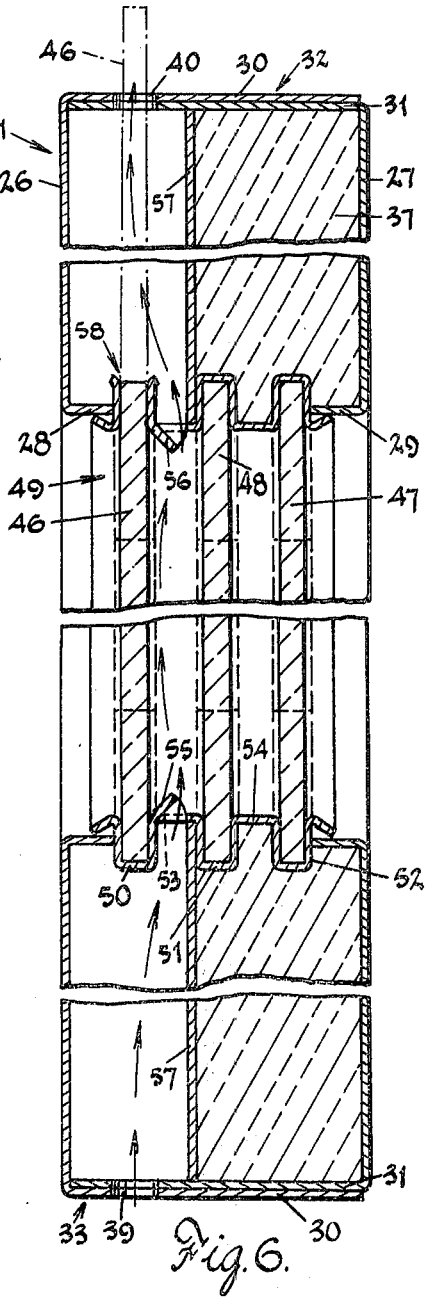
FIG. 6 is a vertical transverse sectional view similar to FIG. 4 but showing another embodiment of the invention.
Figure 7:
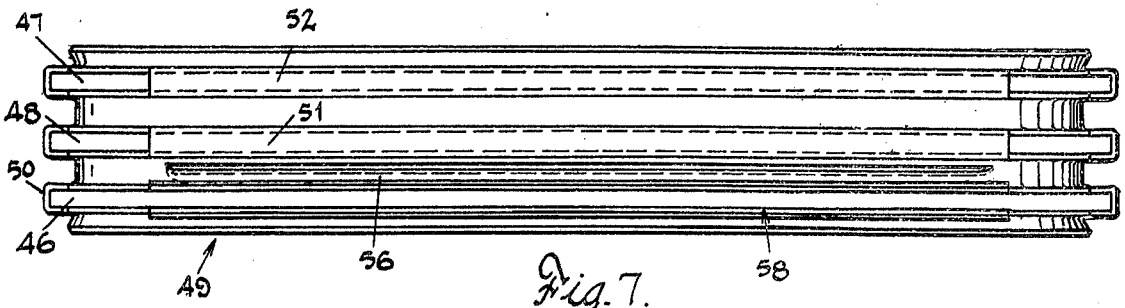
FIG. 7 is a top view of the window unit of FIG. 6.

In FIGS. 6 and 7 is illustrated another embodiment of the oven door which incorporates the principles of the present invention. The main difference between the oven door here shown and that disclosed in FIG. 4 is that the window unit includes three spaced parallel glass panels comprising a front or outer panel 46, an inner or rear panel 47 and a center panel 48. The three panels are mounted in a frame 49 of substantially the same design as shown in FIG. 4 except that it is formed with three glass receiving channels 50, 51 and 52 separated by the integral spacer portions 53 and 54.

The window unit of FIGS. 6 and 7 is of substantially the same overall dimensions as the window unit in FIG. 4 so that it is interchangeable with said unit in the oven door 11. To this end, the spaces between the glass panels 46, 47 and 48 are of somewhat less width than two-panel unit. The three glass panels are preferably equally spaced from one another and the louvers 55 and 56 at the bottom and top of the window are formed in the spacer portion 53 between the outer panel 46 and center panel 48. These louvers are of the same design and function in the same way as the louvers 41 and 42 in the two-panel unit of FIG. 4. However, the louver 55 at the bottom of the window is angled upwardly and rearwardly, while the louver 56 at the top of the window is angled rearwardly and downwardly. The vertical partition member 57 is preferably mounted forwardly of the center glass panel 48. The front glass panel 46 can be readily removed from the door in the same manner as set forth above in the description of the two-panel unit by sliding it upwardly through the slots 58 and 40 respectively in the end wall of the channel 58 and top wall 32 of the door.

It is to be understood that the present disclosure has been made only by way of example and that modifications and changes may be resorted to without departing from the spirit and scope of the invention as hereinafter claimed.

I claim:

1. In an oven door structure, in combination, spaced front and rear door panels joined together around their perimeters to provide a top wall, a bottom wall and opposite side walls, said door panels being provided with a window opening, spaced outer and inner glass panels mounted in and closing said window opening, the bottom wall of the door being provided with openings to permit cooler air to flow upwardly into the space between the glass panels and the top wall of said door being provided with a relatively narrow elongated opening through which the hotter air, flowing from the space between said glass panels, exits from the door, said narrow elongated opening being vertically spaced from and in alignment with the outer glass panel and dimensional for passage of said panel therethrough, and means for slidably mounting the outer glass panel in the window opening for vertical movement whereby said outer panel can be removed vertically from the door through the aligned opening in the top wall thereof by upward sliding movement of the said panel.

2. An over door structure as claimed in claim 1, in which the glass panels are mounted in a frame in the window opening and surrounding the peripheral edges of said panels, and in which said frame is provided with a relatively narrow elongated opening spaced from and aligned with the elongated opening in the top wall of the door to permit passage of the outer glass panel upwardly therethrough.

3. An oven door structure as claimed in claim 2, in which said frame comprises spaced channels for receiving the peripheral edges of the glass panels therein and a spacer portion between said channels, the openings for the circulation of air through the space between the glass panels being formed in said spacer portion, and in which the elongated opening in the frame for passage of the outer glass panel is formed in the respective channel.

4. An oven door structure as claimed in claim 3, in which the openings in th spacer portion are in the form of elongated louvers.

5. An oven door structure as claimed in claim 3, including a vertical partition member mounted in the door substantially midway between the outer and inner glass panels and dividing the interior of the door to provide a space rearwardly of the partition member and a space forwardly of said partition member, the space forwardly of the partition member being open, with the openings in the top and bottom walls of the door communicating with said open space.

6. An oven door structure as claimed in claim 3, in which the window comprises three spaced parallel glass panels including an outer panel, a center panel and an inner panel, in which said frame comprises three spaced channels for receiving the peripheral edges of the glass panels therein and spacer portions between said channels, and in which the narrow elongated opening in the frame is provided in the end wall of the outer channel.

7. An oven door structure as claimed in claim 6, including a vertical partition member mounted in the door forwardly of the center glass panel and dividing the interior of the door to provide a space rearwardly of the partition member and space forwardly of said partition member, and in which insulating material is disposed in the space rearwardly of the partition member, the space forwardly of said partition member being an open space, with the openings in the bottom and top walls of the door communicating with said open space.

8. An oven door structure as claimed in claim 6, in which the openings for the circulation of air through the space between the glass panels are provided in the spacer portion between the outer and center glass panels.

9. An oven door structure as claimed in claim 8, in which said openings in the spacer portion are in the form of elongated louvers.

* * * * *